US009060222B2

(12) United States Patent
Feistel et al.

(10) Patent No.: US 9,060,222 B2
(45) Date of Patent: Jun. 16, 2015

(54) METHOD FOR DETERMINING AN AVERAGED FREQUENCY-DEPENDENT TRANSMISSION FUNCTION FOR A DISTURBED LINEAR TIME-INVARIANT SYSTEM, EVALUATION DEVICE AND COMPUTER PROGRAM PRODUCT

(75) Inventors: Stefan Feistel, Berlin (DE); Alexandru Radu Miron, Berlin (DE); Wolfgang Ahnert, Berlin (DE); Rainer Feistel, Lambrechtshagen (DE)

(73) Assignee: SDA SOFTWARE DESIGN AHNERT GMBH, Berlin (DE)

( * ) Notice: Subject to any disclaimer, the term of this patent is extended or adjusted under 35 U.S.C. 154(b) by 759 days.

(21) Appl. No.: 13/377,215

(22) PCT Filed: May 21, 2010

(86) PCT No.: PCT/DE2010/000571

§ 371 (c)(1),
(2), (4) Date: Feb. 17, 2012

(87) PCT Pub. No.: WO2010/142262

PCT Pub. Date: Dec. 16, 2010

(65) Prior Publication Data

US 2012/0143553 A1 Jun. 7, 2012

(30) Foreign Application Priority Data

Jun. 11, 2009 (DE) ..... 10 2009 025 117

(51) Int. Cl.
*H04R 3/04* (2006.01)

(52) U.S. Cl.
CPC ..... *H04R 3/04* (2013.01)

(58) Field of Classification Search
CPC ..... G01R 23/20; G01M 11/0292; H04R 3/04
USPC ..... 702/109, 182–190
See application file for complete search history.

(56) References Cited

U.S. PATENT DOCUMENTS 4,628,530 A * 12/1986 Op De Beek et al. ..... 381/103
5,187,692 A 2/1993 Haneda

FOREIGN PATENT DOCUMENTS

DE 2313141 9/1974
DE 102006004105 A1 8/2007

OTHER PUBLICATIONS

Ahenrt et al.: "Software-based Live Sound Measurements, Part 2" Audio Engineering Society Convention Paper, 123rd Convention, 7304, Oct. 5, 2007-Oct. 8, 2007 pp. 1-14, XP002602283 New York.*

(Continued)

*Primary Examiner* — Phuong Huynh
(74) *Attorney, Agent, or Firm* — Sutherland Asbill & Brennan LLP

(57) ABSTRACT

The invention relates to a process for determining an averaged frequency-dependent transfer function for a perturbed linear time-invariant system by means of an evaluation device, wherein the process comprises providing frequency-dependent reference signals derived from excitations input in a linear time-invariant system, providing frequency-dependent measuring signals for the linear time-invariant system associated with the frequency-dependent reference signals, and determining an averaged frequency-dependent transfer function for the linear time-invariant system, in that, using signal deconvolution of mutually associated measuring and reference signals, frequency-dependent transfer functions are determined and the frequency-dependent transfer functions are averaged, and wherein during determination of the averaged frequency-dependent transfer function at least a part of the determined frequency-dependent transfer functions is included in the averaging corresponding to a respectively associated frequency-dependent weighting. Furthermore the invention comprises an evaluation device for determining an averaged frequency-dependent transfer function for a perturbed linear time-invariant system and a computer program product.

8 Claims, 7 Drawing Sheets

(56) References Cited

OTHER PUBLICATIONS

Figure 1:
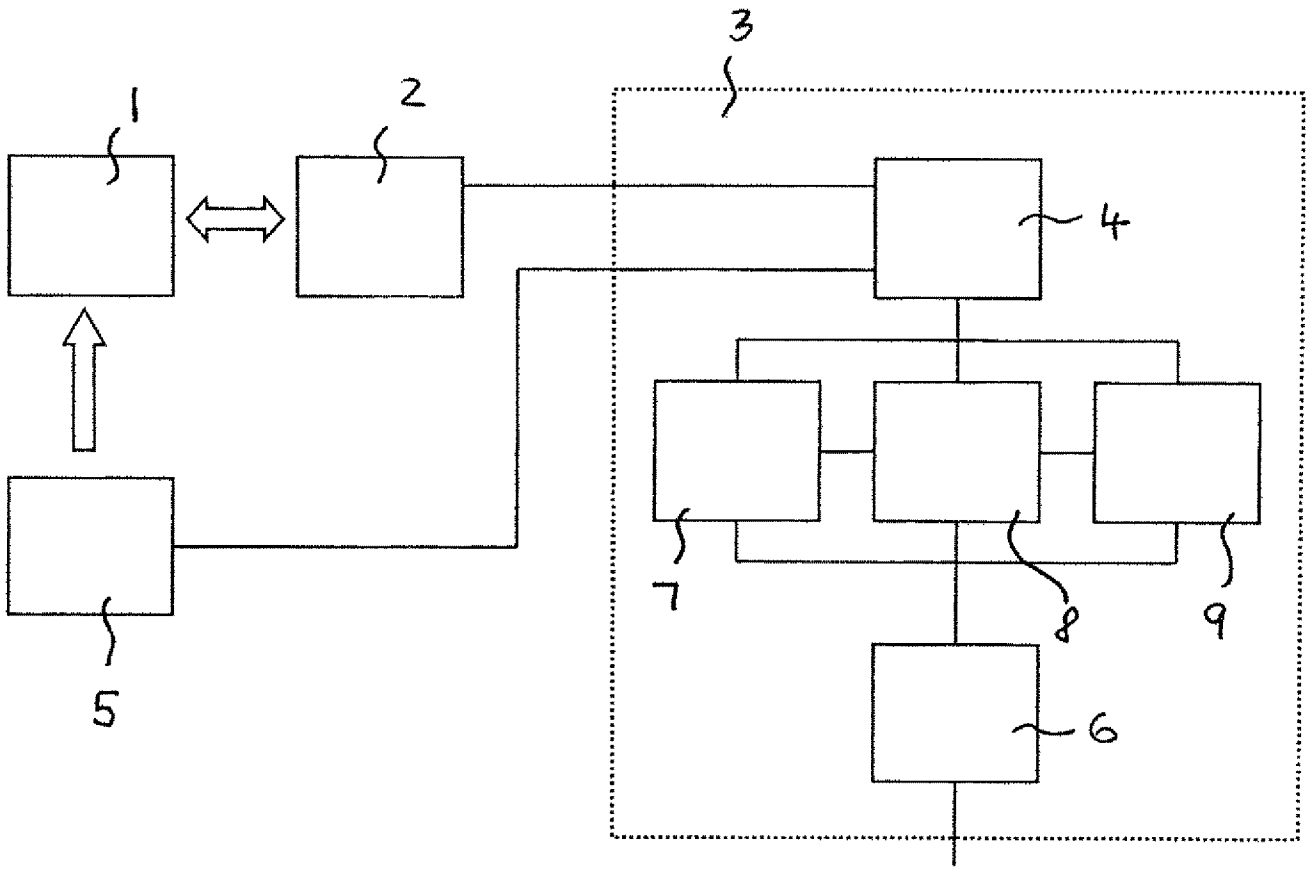

Ahnert, "Software-based Live Sound Measurements, Part 2," Audio Engineering Society Convention Paper, Oct. 5, 2007, 14 pages,123rd Convention 7304, New York, NY.

Thomas, "Using the Coherence Function as a Means to Improve Frequency Domain Least Squares System Identification," Russ College of Engineering and Technology of Ohio University, Mar. 30, 2007, 101 pages, University of Ohio, Athens, OH.

International Search Report of PCT Application No. PCTDE2010000571, mailed Oct. 15, 2010.

* cited by examiner

METHOD FOR DETERMINING AN AVERAGED FREQUENCY-DEPENDENT TRANSMISSION FUNCTION FOR A DISTURBED LINEAR TIME-INVARIANT SYSTEM, EVALUATION DEVICE AND COMPUTER PROGRAM PRODUCT

CROSS-REFERENCE TO RELATED APPLICATIONS

This is a submission pursuant to 35 U.S.C. 154(d)(4) to enter the national stage under 35 U.S.C. 371 for PCT/DE2010/000571, filed May 21, 2010. Priority is claimed under 35 U.S.C. 119(a) and 35 U.S.C. 365(b) to German Patent Application Number 10 2009 025 117.0, filed Jun. 11, 2009. The subject matters of PCT/DE20101000571 and German Patent Application Number 10 2009 025 117.0 are expressly incorporated herein by reference.

FIELD OF THE INVENTION

The invention relates to a process for determining an averaged frequency-dependent transfer function for a perturbed linear time-invariant system, an evaluation device and a computer product.

BACKGROUND OF THE INVENTION

Existing disturbances and short-time fluctuations have a great influence on practical measurements in many linear time-invariant systems. They limit the possible quality of the result. This is the case, in particular, when measurements are taken with spectrally limited or time-limited and interrupted excitation signals, such as with speech or music signals in audio engineering and acoustics.

A variety of processes are known which have been proposed in order to improve measuring results:

- taking the average across several measurements, which increases the signal-to-noise-ratio by 3 dB for each doubling of the number of measurements if the interference is not correlated. The user can choose whether to take a complex or power average. This may result, depending on boundary conditions, in a further improvement.
- statistical coherence is used in order to allow the user to draw frequency-dependent conclusions as to the usability or validity of the measurement.
- it is possible to explicitly filter out frequency ranges by letting the user specify the filter function to be used. The time response filtered in this way may then be subjected to further investigations.
- it is possible to perform a frequency analysis by windowing of the transfer function in the time domain, i.e. of the impulse response. Although this increases the signal-to-noise-ratio by excluding earlier or later portions in terms of time, it simultaneously prevents, depending upon the process used, the acquisition of a full system response.
- it is possible, in a separate measurement, to determine a mean noise level, which allows the user to estimate the signal-to-noise-ratio present during the actual measurement, thus supporting any decision on taking further measures.

None of these methods refer to the use of signals which are limited with regard to time and frequency and which, at the same time, vary both with regard to time and frequency, such as speech and music. In contrast to the automated approach the above methods are to be understood merely as interactive tools for the user during measuring. Interpretation and correct course of action are still left to a large extent to the user.

Measuring processes typically pursue one of the two following aims: (i) determination of the transfer function while exciting the system using the measuring apparatus itself, (ii) determination of the original signal input into a system through the approximate removal of changes by the system from the output signal.

In document DE 2 313 141 a process and an arrangement for averaging the transfer functions of systems in real time have been disclosed. With the known process for averaging the transfer functions of systems in real time provision is made for simultaneously forming the Fourier transforms of the input and output data and dividing these two transforms by each other.

In document DE 10 2006 004 105 A1 a device and a process for processing measured values has been disclosed. A measured value transducer is used for translating measured values into output signals.

SUMMARY OF THE INVENTION

It is the requirement of the invention to specify improved technologies for determining the frequency-dependent transfer function for a perturbed linear time-invariant system.

According to the invention this requirement is met by a process for determining an averaged frequency-dependent transfer function for a perturbed linear time-invariant system according to independent claim 1. Further, a system for determining an averaged frequency-dependent transfer function for a perturbed linear time-invariant system as well as a computer program product are provided according to independent claims 7 and 8. Advantageous arrangements of the invention are the subject of dependent sub-claims.

According to one aspect, the invention comprises the idea of a process for determining an averaged frequency-dependent transfer function for a perturbed linear time-invariant system by means of an evaluation device, wherein the process comprises the following steps: providing frequency-dependent reference signals derived from excitations acting upon a linear time-invariant system, providing frequency-dependent measuring signals for the linear time-invariant system which are associated with the frequency-dependent reference signals, and determining an averaged frequency-dependent transfer function for the linear time-invariant system in that using signal deconvolution of measuring signals associated with each other, frequency-dependent transfer functions are determined and these frequency-dependent transfer functions are averaged, wherein during determination of the frequency-dependent transfer function at least a part of the determined frequency-dependent transfer functions is used in the averaging process corresponding to a respectively associated frequency-dependent weighting.

According to a further aspect of the invention an evaluation device for determining an averaged frequency-dependent transfer function for a perturbed linear time-invariant system is provided which has the following characteristics:

- a plurality of input channels which are configured to receive the frequency-dependent reference signals derived from excitations acting upon a linear time-invariant system and frequency-dependent measuring signals for the linear time-invariant system associated with the frequency-dependent reference signals, and
- an evaluation unit coupled to the several input channels and configured to determine an averaged frequency-dependent transfer function for the linear time-invariant system, in that using signal deconvolution of associated measuring signals and reference signals, frequency-dependent transfer function are determined and these frequency-dependent transfer functions are averaged, wherein during determination of the averaged frequency-dependent transfer functions at least a part of the determined frequency-dependent transfer functions is used in the averaging process corresponding to a respectively associated frequency-dependent weighting.

A further aspect of the invention comprises a computer program product.

The invention provides for the determination of the frequency-dependent transfer function for a linear time-invariant system by averaging frequency-dependent transfer functions which have been determined by means of deconvolution from reference signals and associated measuring signals. The previously determined frequency-dependent transfer functions corresponding to a respectively frequency-dependent weighting are entered into the averaging process. It is possible to use different frequency-dependent weighting methods.

The proposed technologies permit determination of the linear transfer function using the original input signal without having a priori knowledge of the same or presuming its properties.

Frequency-dependent weighting permits, in particular, the frequency-selective treatment of perturbation signals such as sine waves and thus their exclusion, without influencing other parts of the measured spectrum. In case of block-by-block handling, i.e. the determination and evaluation of several transfer functions, a treatment of time-dependent disturbances is additionally possible. Block-by-block measuring, in terms of the present application, provides for the reception and evaluation of several sets of raw data, typically sequentially, optionally overlapping. Correspondingly a block is to be understood as a single set of raw data or as a single measured transfer function. In contrast thereto several blocks are several such data sets.

Measured values from non-excited frequencies, such as with speech or music excitation, may also be excluded from the measuring process. Finally, in one embodiment, a frequency-dependent minimum signal-to-noise-ratio for example may be required which may be adapted for example, similar to what happens in practice, to varying behaviours of the system in the low and high frequency ranges. Conversely, the known averaging of measured data results in the unconditional inclusion of all perturbation signals in the averaged value. Its quality is thus primarily determined by the perturbation signal to useful signal ratio during the measuring operation as well as from the averaging duration.

Measuring of the perturbed linear time-invariant system takes place within a spectral range of interest. This is limited by a lower limiting frequency f. Changes in the measured system response which happen within time spans shorter than about 100/f, are regarded as disturbancess. Changes happening within time spans greater than about 100/f and where the amplitude is smaller than the measurement uncertainty, are also regarded as disturbances. Changes happening within time spans greater than about 100/f and where the amplitude is larger than the measurement uncertainty, are regarded as a slow change in the system in relation to the measuring process and are recorded and mapped by the measuring process, optionally in real time. In addition it is presumed that for excitation with an arbitrary signal it is true to say of the system response that the amplitude of time-invariant non-linear portions lies below the amplitude of the linear portions by at least a factor of about 10.

Determination of the averaged transfer function may be performed in real time. The inputs of the evaluation device are evaluated whilst further data are being received at the input in parallel.

Provision may also be made for making use of the invention during subsequent processing. Here inputs are present as analogue or digital data and are fed into the measuring system. Filtering may be arranged at any time after downstream of the reception of the raw data independent of time. Measured raw data are typically initially converted into an electric signal, digitised and recorded. Evaluation as such then takes place by means of feeding the data or playing them back, into an evaluation device. The asynchronisity of this operation has some advantages in practice.

Thus, for example, evaluation parameters can be better optimised since the available time in situ is usually limited at the time of measuring. In particular, the evaluation operation may be repeated in that the data is input again but with different evaluation parameters, whereas individual events in the raw data can, by nature, not be reproduced in situ at the time of data acquisition. Also direct evaluation in situ is sometimes not possible due to local conditions (measurements at the South Pole or similar) or due to time scales (years in oceanography).

In a preferred further development of the invention provision is made, during determination of the averaged frequency-dependent transfer function, for an existing averaged frequency-dependent transfer function to be averaged with a currently determined frequency-dependent transfer function, wherein the currently determined frequency-dependent transfer function is included in the averaging process according to the associated frequency-dependent weighting. As part of determining the averaged frequency-dependent transfer function for the linear time-invariant system therefore, a currently determined frequency-dependent transfer function is averaged with the existing and previously determined mean value for the transfer function.

In a convenient arrangement of the invention provision may be made for the at least one part of the determined frequency-dependent transfer function to be weighted according to a respective frequency-dependent threshold value function. For the analysis of an input spectrum or the calculation of a transfer function this involves, in one arrangement, transforming the time signal of an input channel block-by-block into the frequency range. If the input spectrum is to be analysed directly, these blocks are averaged directly after the Fourier transformation. If the transfer function is calculated the input spectra are not averaged.

In one arrangement Fourier transformation is defined as follows:

$$S(f_j)=F(s(t_i)).$$

Here s(ti) stands for the incoming sampled time signal of amplitude s at points of time ti, F stands for the discrete Fourier transform over a time range i=1 . . . N and S(fi) for the resulting discrete complex amplitude spectrum with values S for frequencies fj.

In the process which is relevant here, however, in both cases mentioned above, the now frequency-dependent data are subjected to a logical filter which in the simplest case requires a frequency-dependent minimum amplitude, which means exceeding a threshold value. Amplitude values at some frequency not reaching this threshold are therefore excluded from averaging or further processing. In practice this is realised, for example, in such a way that the user initially measures the noise spectrum in the input channel and then uses this as the value for comparison. Typically a signal-to-noise-ratio is specified which thus defines, in a frequency-dependent manner, the signal amplitude which must be reached in order to be able to further process the respective measurement, again in a frequency-dependent manner.

Further processing of the amplitude value of a single frequency j therefore requires that in the embodiment the following condition is met:

$$|S(f_j)|>|G(f_j)|,$$

wherein $G(f_j)$ represents the threshold function which is defined as amplitude G for frequency $f_j$. Further processing comprises, in particular, deconvolution of the reference and measuring signals as well as averaging the transfer functions measured.

The comparison of S and G can include not only the modulus but can also be defined on the basis of real and imaginary parts or via another mathematical metric.

Given a known or assumed noise spectrum N(fj) G is defined as the sum of this spectrum and a possible frequency-dependent signal-to-noise-ratio D(fj) which at least must be achieved:

$$G(f_j)=N(f_j)+D(f_j).$$

Alternatively a dynamic range B may be defined which for example, depending upon the maximum or mean signal amplitude across the whole or a part of the frequency range of the respective block, excludes the measured value for a frequency if this value is too low:

$$|S(f_j)|>\max\{|S(f_j)|\text{for all } j\}-B.$$

This is a special realisation of G(fj) which here is also a function of S, i.e.

$$G=G(f_j,S).$$

In summary it can be stated that the threshold filter is in principle set up in such a way that it permanently removes from the input signal all existing components which are not created by the excitation signal and which also exist in the non-excited state of the system to be measured.

An advantageous embodiment of the invention provides for the at least one part of the determined frequency-dependent transfer function to be weighted corresponding to a respective frequency-dependent metric distance function, wherein the metric distance function indicates the frequency-dependent weighting as a function of a metric distance between the existing averaged frequency-dependent transfer function and the currently determined frequency-dependent transfer function. For determining the transfer function a so-called "excursion filter" is used in this embodiment which filters out short-term high-level disturbances from the measurement. This filter is applied immediately after the calculation of the transfer function from the input signals. Initially the transfer function is defined as a spectral function which results from the deconvolution of two input signals. If SY is the main signal and SX the reference signal to be used for comparison, then the transfer function H in the frequency domain is $$H(f_j)=S^Y(f_j)/S^X(f_j).$$

When viewed in detail various processes can be used at this point which prevent the result from diverging due to too small divisors. There are various known ways of realising these processes (see for example B. Buttkus, "Spectral Analysis and Filter Theory in Applied Geophysics", Springer-Verlag, Berlin Heidelberg 2000). The threshold analysis described above may also be used in order to exclude values of SX(fj) that are of insufficient magnitude.

The "excursion filter" embodiment in one arrangement presumes that the transfer function is known to a certain extent, be it from assumptions or from previous measurements. Application of a further filter is provided which, in particular, is important to the averaging across several above-mentioned measurements of the transfer function. The filter may consist of two components of which, however, only one may be applied. On the one hand a complex tolerance margin T(fj) is defined within which acceptable values, i.e. values considered valid, must be present in order to satisfy the assumption of a time-independent system within a permitted measurement uncertainty:

$$|H(f_j)-H_0(f_j)|<|T(f_j)|,$$

wherein $H_0(f_j)$ represents the comparative value which may be specified or be derived from measurements. Here again the modulus is to be understood as a typical metric, but under certain conditions, only the phase deviation, for example, or another distance term defining a metric in mathematical terms may be relevant.

The second component to be used may be a continuous weight function W(fj), which is interesting in particular for the ongoing forming of the mean value. Here the new measured value H(fj) is entered into the mean value HM(fj) or HMNew(fj) only in dependence of its deviation from the comparative value H0:

$$H_M^{New}(f_j)=c\cdot[H_M(f_j)+H(f_j)\cdot W(f_j)],$$

wherein c represents a normalization constant for the determination of the mean value, which is unimportant for our purposes. The $W(f_j)$ function is understood to be a function of measured value and comparative value $W=W(H(f_j), H_0(f_j))$, which for example may be an exponential attenuation:

$$W(f_j)=W_0\cdot\exp(-|H(f_j)-H_0(f_j)|),$$

wherein $W_0$ is again a normalization constant. Another important realisation is a flat-top function, which permits a free change within a tolerance margin $T(f_j)$ and defines a distance-dependent weighting outside the margin, for example as half a cosine of width b:

$$W(f_j) = W_0.\begin{cases}1 & \text{if } |H(f_j) - H_0(f_j)| < |T(f_j)| \\ \dfrac{\mathrm{Cos}((|H(f_j) - H_0(f_j)| - |T(f_j)|)\cdot PI/b)}{2+0,5} & \text{if } |H(f_j) - H_0(f_j)| < |T(f_j)| + b \\ 0 & \text{otherwise.}\end{cases}$$

This realisation would correspond, for example, to a Tukey window in relation to the amplitude difference to the comparative value.

In all, the "excursion filter" embodiment may be defined in such a way that measured values are removed (optionally frequency-dependent), which occur only in the short term and which deviate strongly from the expected value. With this procedure it must be guaranteed that during application of a real time measurement it is possible to follow a slowly changing system, i.e. that permanent changes in the transfer function are not being excluded but are accepted with a well-defined inertia.

Preferably a further development of the invention provides for the at least one part of the determined frequency-dependent transfer function to be weighted corresponding to a respective frequency-dependent correlation function, wherein the correlation function indicates the frequency-dependent weighting for a frequency-dependent transfer depending upon a correlation between the frequency-dependent reference signal and the associated frequency-dependent measuring signal, from which the frequency-dependent transfer function is determined. A filter is thereby formed, which evaluates measured values on a coherence basis, wherefore one can also speak of a coherence filter. In a possible embodiment the statistical measure of coherence is used in order to determine the magnitude of the linear dependence of two input signals from each other. In a possible embodiment this is a prerequisite for determining the linear transfer function for each deconvolution. Based on the coherence the measured values are then either discarded or further processed. Other measures similar to coherence may also be used in order to determine the linear dependence of both input signals, for example cross-correlation. Coherence is generally defined as $$C_{XY}(f_j)=|\langle H(f_j)\rangle|^2\cdot\langle|S^X(f_j)|^2\rangle/\langle|S^Y(f_j)|^2\rangle.$$

Here the mean value function $\langle\ldots\rangle$ defines the mean value across several measured blocks of raw data.

In one arrangement of the process the above-mentioned raw mean values $\langle\ldots\rangle$ are initially determined for each frequency fj on the basis of block-based raw data. These may, for example, be a defined number of incoming blocks, $\langle F\rangle=\Sigma Fk/N$, or an on-going averaging with a decay time constant $\tau$, in the form $\langle F\rangle\sim\Sigma Fk\exp(-k/\tau)$. Via the coherence calculated from these values it is then determined whether the respective (raw) measured value $\langle H(fj)\rangle$ shall be included in the mean result value HM(fj). This calculation is again performed using a weight function V, which now is defined on the basis of coherence CXY:

$$H_M^{New}(f_j)=c\cdot[H_M(f_j)+\langle H(f_j)\rangle\cdot V(f_j)].$$

For example a fixed coherence threshold value CCrit is used which determines frequency-dependently, whether a (raw) measured value is included in the on-going mean result value:

$$V(f_j)=\begin{cases}1 & \text{if } C_{XY}(f_j)>C_{Crit}\\ 0 & \text{otherwise.}\end{cases}$$

Alternatively the weight function may be defined as a smooth function and thus further process measured values depending upon and weighted with, the respective value of its coherence.

This additional filter is intended, in particular, for excluding short-term disturbances or noise not correlated with the excitation signal, in the amplitude range of the excitation signal from the resulting measurement. It is often advantageous in practice to provide for the upstream inclusion of the above-described "excursion filter" since for very large signal amplitudes the actual measured value H(fj) dominates the coherence and can thus heavily falsify the entire measurement.

With an advantageous arrangement of the invention provision may be made for determining the averaged transfer function in terms of a real time measurement for the linear time-invariant system. With this embodiment the transfer function of the system examined is determined once or several times in real time.

Aspects of the invention will now be described in detail.

The invention provides for one or more signal processing steps which can distinctly increase the result quality during determination of the transfer function and/or reduce measurement errors. The technologies according to the invention can be realized with the aid of processes and/or devices. By way of example an application of the invention will now be demonstrated, above all in a supplementary fashion, in acoustics and in audio engineering, to which however, application of the mentioned technologies is not limited.

It is assumed that the excitation signal may be irregular, i.e. may be interrupted in terms of time and spectrum, and a priori is not known. The process reveals its advantages in particular during measuring of systems which are exposed to one or more disturbances. Processing may be understood as filtering and working in time slots and this may be carried out in real time or as a step separate, in terms of time, from taking measurements. In practice the ability to work in real time, in particular, is all important because speech or music signals are used in live situations. At least one, but as a rule two or more measuring channels are used.

In the embodiment shown filtering takes place on several levels and is preferably to be used in this combination to counteract typical disturbance effects in the situations described. In one arrangement, in a first step ("threshold filter"), the input signals are pre-filtered channel-by-channel with regard to a minimum signal-to-noise-ratio; alternative or additional criteria are possible. Subsequently, in a second step, short-term sound events of high amplitude are treated by means of exclusion or weighting based on previously determined measured values by checking the time invariance of the measured system ("excursion filter"). As a third step, in a convenient arrangement the statistical measure of coherence is employed in order to use only highly correlated portions of the input signals for the calculation of a transfer function ("coherence filter").

All these steps are taken using frequency resolution. Averaging and smoothing processes may be used additionally. It should be pointed out that the processing steps described are performed typically automatically in a software implementation and no further user-interaction is needed after setting up the start configuration.

Although the process is described by way of example comprising three steps the combination of which results in particularly advantageous results, provision may be made in other embodiments in deviation thereof for one or even two of the steps to be omitted because respective disturbances do not occur and therefore need not to be taken account of in the process. Thus for example provision may be made for only the second and/or the third step to be applied.

Measurements of linear, time-invariant systems are, as a rule, performed in two different ways. In a simple form an output signal leaving the system is measured, and this may be excited by the measuring apparatus itself or generated by a secondary source. Here the signal spectrum being created is of particular interest. Typical measurements are performed using pink noise or white noise. In an advanced form two signal channels are used and a transfer function determined on this basis. One signal serves as a reference signal and thus defines the input into the system to be measured, and the other signal is understood as the output from the system to be measured. Eventually the impulse response or transfer function of the system is determined by comparison. i.e. deconvolution of the two signal channels.

Although the following process is based on one input signal and one output signal, it can generally be used for determining the linear transfer function of a system on the basis of a certain number of input channels and a certain number of output channels. The channels can be understood as time series of very small (for example microsecond range) to very large scales (for example annual range). Where several input or output channels are used the later-described process steps and variables are to be understood to be multi-dimensional.

In the practice of acoustics both the measuring signal spectrum and the transfer function may be used for accurate acoustic tuning of the system in the frequency range. In addition the transfer function is used in the time or frequency range for the time alignment of several sound sources, usually loudspeakers. For such applications quick determination of a result with a minimum of uncertainty is of great interest. This applies, in particular, to cases where speech or music signals are used, which are fed in any case into the system to be measured. Their strong time variation and spectral variation places increased demands on evaluation in comparison to typical excitation signals such as pink noise or sine sweep, and usually leads, without appropriate processing, to a considerably prolonged measuring duration, increased evaluation expenditure and increased susceptibility to errors.

The transfer function is also important to electrical applications, such as measurements of power amplifiers, loudspeakers or individual electronic components. In this case frequency responses or frequency-dependent complex impedances are measured. Here again irregular signals in terms of spectrum and time may be used, in particular if the system to be measured is not excited by the measuring apparatus itself.

Another feasible field of application for the proposed technologies is oceanography, where the transfer function is understood as a response function of an inland sea or ocean on scales of months or years. If the prerequisites for a linear time-invariant system are present, time series for vertical temperature layering and local salinity for example, may be understood as a function of time series for sun irradiation and wind intensities and wind directions.

Further fields of application may be for example of a climatological or geophysical nature. Here too provision may be made to extract the linear transfer function of the examined system from measured time series for various state variables which describe the system.

The invention combines several process aspects, which when used together are particularly suited for achieving the objective, since all disturbance effects frequently occurring in practice may be hereby excluded. This may be, above all, (i) background noise or incidental low-level continuous noise, (ii) short-term high amplitude noise and (iii) systematically occurring noise at a level similar to the excitation signal, but which do not correlate with the excitation signal.

The errors always occurring in practice due to above three central and principal causes are essentially compensated for by means of the partial processes complementing each other, whereby measurement uncertainty is minimised. A combination of the partial steps permits safe use of the measuring process in typical practical situations.

The method for determining the transfer function by using the proposed spectral selective accumulation is employed, in order to determine a time-independent spectral transfer function as well as its frequency-dependent uncertainty from a reference signal, which is highly inhomogeneous in the frequency range, especially in acoustic and in audio engineering live sound, and very variable in the time range, and a measuring signal, which is highly inhomogeous in the frequency range and very disturbed and very variable in the time range.

While measuring is in progress the existing version of the transfer function is constantly compared with the currently recalculated one at each frequency point. In particular, it is a requirement that a valid new measured value must lie within the estimated uncertainty of the existing value, and the existing one within the estimated uncertainty of the new measured value. Depending upon the result of this comparison the new value is either discarded and the old one retained, or the old value is discarded and the one adopted, or the old value is combined with the new one subject to the condition that the combined value has a smaller uncertainty than the old one and the new one. In this way the process will lead, inevitably, to a systematic reduction of the uncertainty of the determined transfer function, due to accumulation of the measured results over time.

In the main three different processes are used for estimating the uncertainty of a measured value. Firstly the transient amplitude of the reference signal at each frequency point is compared with a previously estimated or measured noise threshold using the "threshold value process". Secondly, using the "excursion process", the apparent change over time in the amplitude of the transfer function is checked at each frequency point across the time. Thirdly, using the "coherence process", the correlation, over time, of the change in the measuring signal with the change in the reference signal is determined at each frequency point. The mentioned processes complement each other, but need not necessarily be used together.

DESCRIPTION OF PREFERRED EMBODIMENTS OF THE INVENTION

Figure 2:
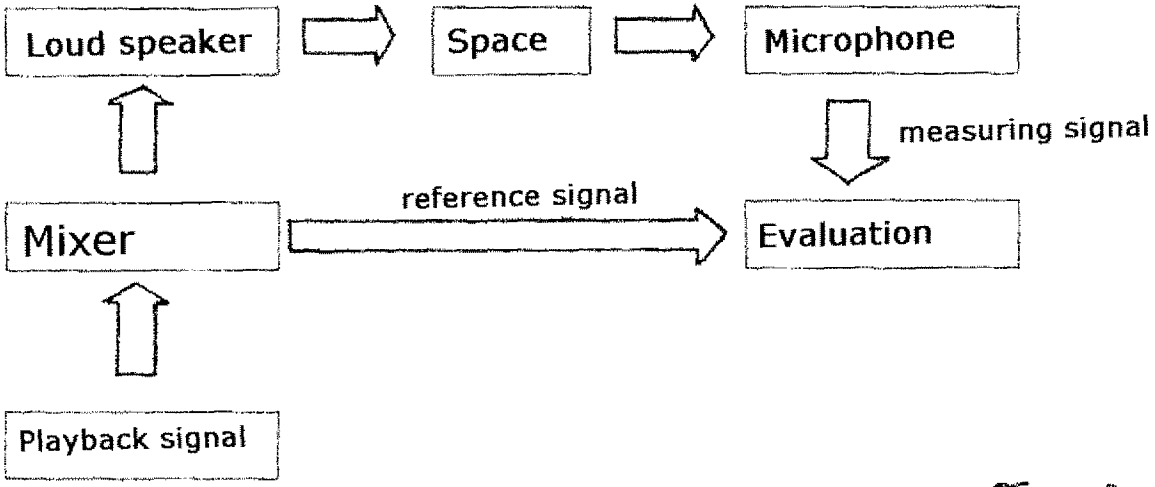
Figure 3:
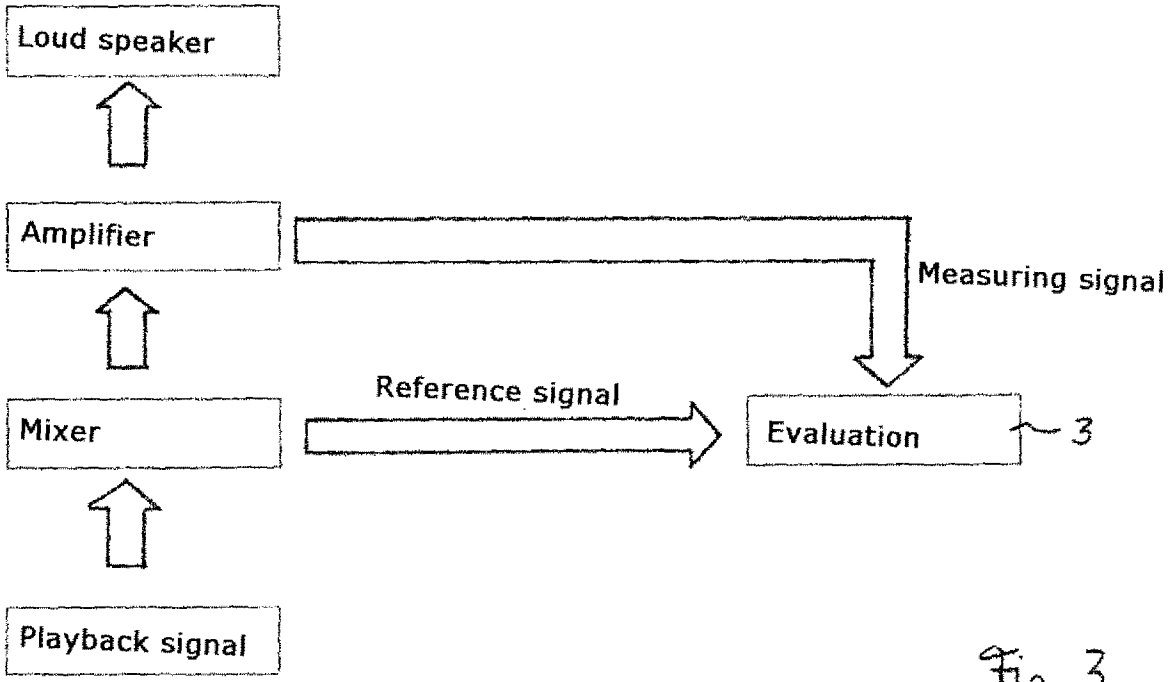
Figure 4:
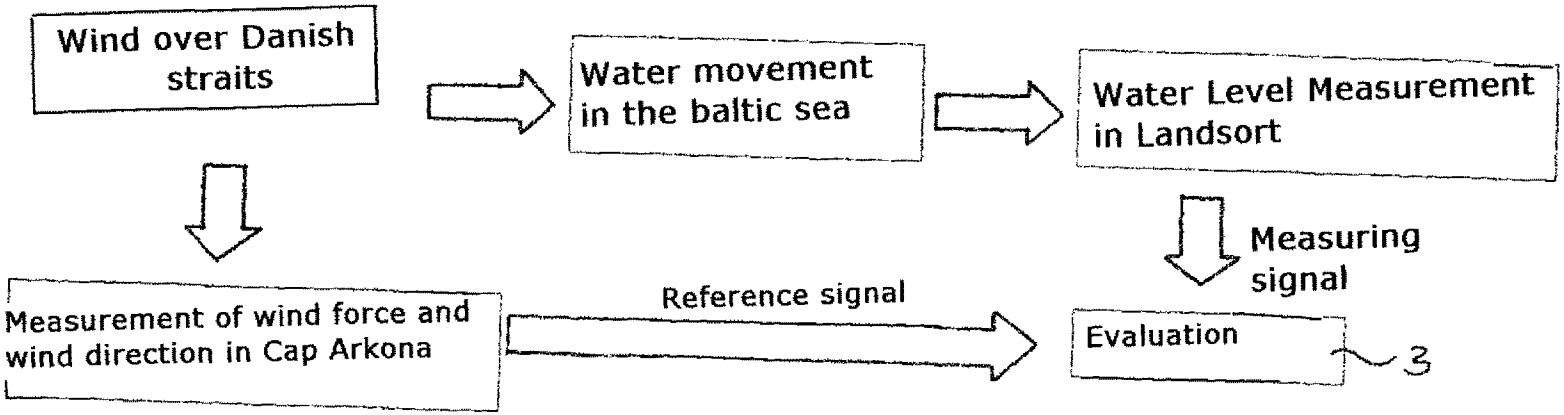
Figure 5:
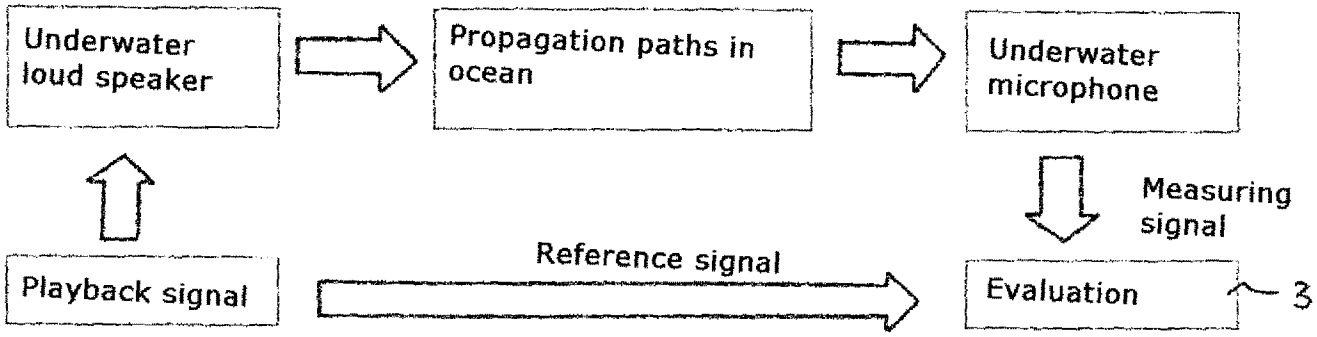
Figure 6:
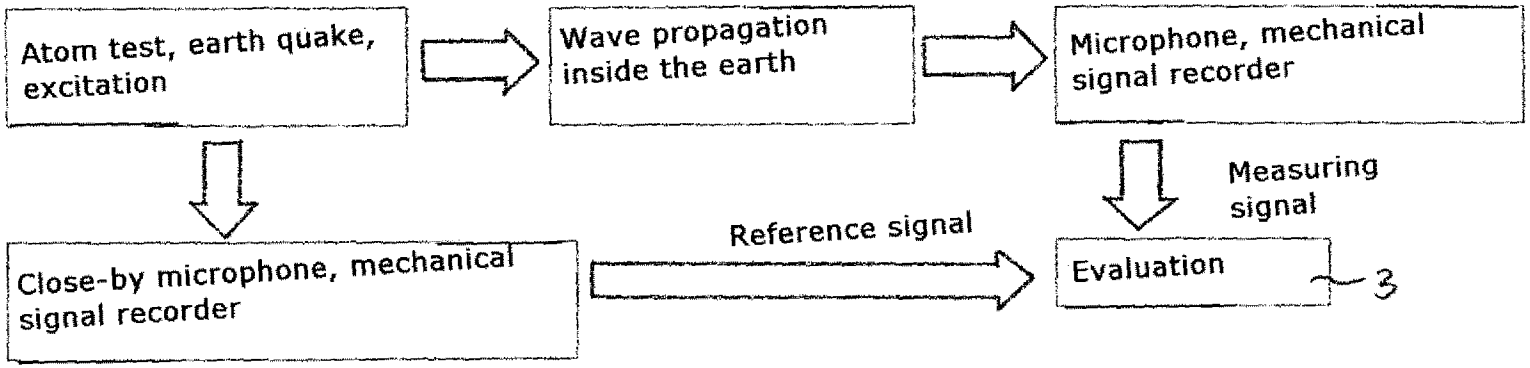
Figure 7:
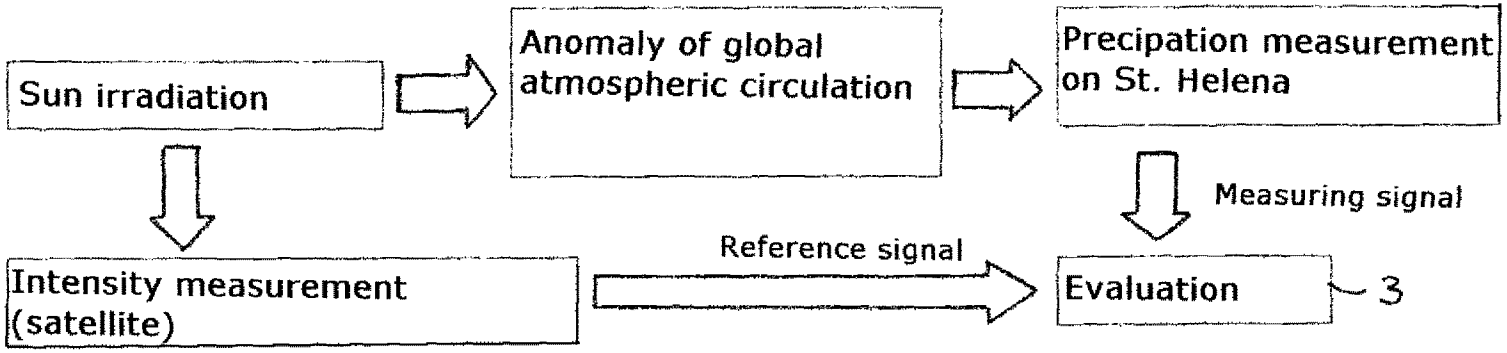

The invention will now be discussed in detail by way of preferred embodiments with reference to the figures of a drawing, in which FIG. 1 shows a schematic drawing of an arrangement for determining an averaged frequency-dependent transfer function for a linear time-invariant system, FIG. 2 shows a schematic drawing of an arrangement for determining an averaged frequency-dependent transfer function in conjunction with an acoustic real time measurement, FIG. 3 shows a schematic drawing of an arrangement for determining an averaged frequency-dependent transfer function in conjunction with an electric test measurement, FIG. 4 shows a schematic drawing of an arrangement for determining an averaged frequency-dependent transfer function in conjunction with an oceanographic measurement, FIG. 5 shows a schematic drawing of an arrangement for determining an averaged frequency-dependent transfer function in conjunction with an acoustic tomography, FIG. 6 shows a schematic drawing of an arrangement for determining an averaged frequency-dependent transfer function in conjunction with a geological measurement, and FIG. 7 shows a schematic drawing of an arrangement for determining an averaged frequency-dependent transfer function in conjunction with a climatological measurement.

FIG. 1 shows a schematic drawing of an arrangement for determining an averaged frequency-dependent transfer function for a perturbed linear time-invariant system.

Corresponding to the schematic drawing of FIG. 1 measuring signals are recorded for a linear time-invariant system 1 using a measuring device 2 and passed to an evaluation device 3. In the evaluation device 3 the measuring signals received via an input 4 are associated with respectively associated reference signals, which are provided in the evaluation device 3 for an excitation source 5. In the evaluation device 3 the frequency-dependent transfer function for the linear time-invariant system 1 is determined by means of evaluating the received measured and reference signals. The result is provided at an output 6.

As part of this process the determined transfer function is averaged such that during a measurement performed for the transfer function a currently determined transfer function is averaged with an existing mean value for the transfer function. With this averaging process the currently determined transfer function is included with a frequency-dependent weighting. In order to perform the frequency-dependent weighting the evaluation device 3 in the embodiment shown is provided with a threshold filter 7, an excursion filter 8 as well as a coherence filter 9. According to the drawing of FIG. 1 one, two or all three filters may be used in conjunction with a frequency-dependent transfer function.

In the following embodiments of the filters are described in detail.

Initially the so-called threshold value process will be explained.

For the analysis of an input spectrum or the calculation of a transfer function the time signal of an input channel, in one arrangement, is transformed block-by-block into the frequency range. If the input spectrum is to be analysed directly, these blocks are directly averaged after the Fourier transformation. If the transfer function is calculated, no averaging of the input spectra takes place.

The Fourier transformation is defined as follows:

$$S(f_j)=F(s(t_i)).$$

Herein s(ti) stands for the incoming sampled time signal of amplitude s at points in time ti, F stands for the discrete Fourier transformation across a time range of i=1 . . . N and S(fj) stands for the resulting discrete, complex amplitude spectrum with values S for frequencies fj.

In the process which is relevant here, however, in both cases mentioned, the now frequency-dependent data is subjected to a logical filter, which in the simplest case requires a frequency-dependent minimum amplitude, i.e. it requires that a threshold value is exceeded. Amplitude values at some frequency which do not reach this threshold, are therefore excluded from averaging or further processing. In practice this is realised in such a way that the user initially measures the disturbance spectrum and then uses it as a value for comparison. Typically a signal-to-noise-ratio is specified defining the signal amplitude frequency-dependently, and this ratio must be achieved in order to ensure further processing of the respective measurement, again frequency-dependently.

For further processing of the amplitude value at a single frequency j therefore the following condition must be met:

$$|S(f_j)|>|G(f_j)|,$$

wherein $G(f_j)$ represents the threshold function, which is defined as amplitude G for frequency $f_j$. The comparison can include not only the modulus but may additionally be defined on the basis of real and imaginary parts or via another mathematical metric. For known or assumed disturbance spectra $N(f_j)$ one would define G as the sum of these spectra and possibly a frequency-dependent signal-to-noise-ratio $G(f_j)$ which at least must be achieved:

$$G(f_j)=N(f_j)+D(f_j).$$

Alternatively a dynamic range B may be defined which, for example, excludes the measured value for a frequency depending upon the maximum or mean signal amplitude across the whole or a part of the frequency range of the respective block, should this measured value be too low in comparison:

$$|S(f_j)|>\max\{|S(f_j)|\text{for all } j\}-B.$$

This is a special realisation of G(fj), which here is also a function of S, i.e.

$$G=G(f_j,S).$$

In conclusion it can be stated that the threshold filter, in principle, is set up in such a way that it removes all permanently present components from the input signal, which are not created by the excitation signal and are present also in a non-excited state of the system to be measured.

In the following a so-called excursion process will be described.

To determine the transfer function this embodiment makes use of a so-called "excursion filter", which filters out short-term, high-level disturbances from the measurement. This filter is used immediately after calculation of the transfer function from the input signals.

Firstly the transfer function is defined as a spectral function resulting from the deconvolution of two input signals. Let SY be the main signal and SX the reference signal which is used for comparison, then the transfer function H in the frequency domain is $$H(f_j)=S^Y(f_j)/S^X(f_j).$$

Viewed in detail various processes are used at this point which prevent the result from diverging because of too small divisors. These are not part of the invention and are presumed to be generally known. Even so the threshold value analysis described in the previous section may also be used in order to exclude values for SX(fj) which are too small.

The excursion filter assumes that knowledge of the transfer function already exists, be it through assumption or from previous measurements. Here the invention includes the application of an additional filter which is important in particular to the averaging across several above-mentioned measurements of the transfer function.

It may consist of two components of which, albeit, only one has to be applied. On the one hand we define a complex tolerance margin T(fj) within which there must be acceptable values to be regarded as valid in order satisfy the assumption of a time-independent system within a permitted measurement uncertainty:

$$|H(f_j)-H_0(f_j)|<|T(f_j)|,$$

wherein $H_0(f_j)$ represents the comparative value which must be specified or be derived from measurements. Here again, the modulus is to be understood as a typical metric, but under certain conditions, only the phase deviation, for example, or another distance term defining a metric in mathematical terms may be relevant.

The second component used may be a continuous weight function W(fj), which is of interest, in particular, to the ongoing mean value formation. Here the new measured value H(fj) is included in the mean HM(fj) or HMNew(fj) value only in dependence of its deviation from the comparative value H0:

$$H_M^{Neu}(f_j)=c\cdot[H_M(f_j)+H(f_j)\cdot W(f_j)],$$

wherein c represents a normalization constant for the formation of the mean value, which is unimportant for our purposes. The $W(f_j)$ function is understood to be a function of measured value and comparative value $W=W(H(f_j), H_0(f_j))$, which, for example, may be an exponential attenuation:

$$W(f_j)=W_0\cdot\exp(-|H(f_j)-H_0(f_j)|),$$

wherein $W_0$ is again a normalization constant. Another important realisation is a flat-top function, which permits a free change within a tolerance margin $T(f_j)$ and only externally defines a distance-dependent weighting, for example as half a cosine of width b:

$$W(f_j) = W_0.\begin{cases}1 & \text{if } |H(f_j)-H_0(f_j)|<|T(f_j)| \\ \dfrac{\mathrm{Cos}((|H(f_j)-H_0(f_j)|-|T(f_j)|)\cdot PI/b)}{2+0,5} & \text{if } |H(f_j)-H_0(f_j)|<|T(f_j)|+b \\ 0 & \text{otherwise.}\end{cases}$$

This realisation would correspond, for example, to a Tukey window in relation to the amplitude difference to the comparative value.

In all, the "excursion filter" embodiment may be defined in such a way that measured values are removed (optionally frequency-dependently), which occur only in the short term and which deviate strongly from the expected value. With this procedure it must be guaranteed that during application of a real time measurement it is possible to follow a slowly changing system, i.e. that permanent changes in the transfer function are not being excluded but are accepted with a well-defined inertia.

In the following a so-called coherence process is described.

A further filter is formed which during determination of the averaged transfer function evaluates measuring signals on the basis of coherence. Here the statistical measure of coherence is used in order to find out the magnitude of the linear dependence of two input signals from each other. This is a crucial prerequisite for determining the linear transfer function for each deconvolution. Based on the coherence the measured values are then either discarded or further processed. Naturally other measures similar to coherence may also be used in order to determine the linear dependence of both input signals, for example cross correlation.

Coherence is generally defined as $$C_{XY}(f_j)=|\langle H(f_j)\rangle|^2\cdot\langle|S^X(f_j)|^2\rangle/\langle|S^Y(f_j)|^2\rangle.$$

The mean value function < . . . > defines the mean value across several measured blocks of raw data.

When performing the process in practice the above-mentioned raw mean values < . . . > are initially determined for each frequency fj on the basis of block-based raw data. These may, for example, be a defined number of incoming blocks, $\langle F\rangle=\Sigma Fk/N$, or an on-going averaging with a decay time constant τ, in the form $\langle F\rangle\sim\Sigma Fk\exp(-k/\tau)$. Via the coherence calculated from these values it is then determined whether the respective (raw) measured value <H(fj)> shall be included in the mean result value HM(fj). This calculation is again performed using a weight function V, which now is defined on the basis of coherence CXY:

$$H_M^{New}(f_j)=c\cdot[H_M(f_j)+\langle H(f_j)\rangle\cdot V(f_j)].$$

For example a fixed coherence threshold value CCrit is used which determines frequency-dependently, whether a (raw) measured value is included in the on-going mean result value:

$$V(f_j)=\begin{cases}1 & \text{if } C_{XY}(f_j)>C_{Crit}\\ 0 & \text{otherwise}\end{cases}$$

Alternatively the weight function may be defined as a smooth function and thus further process measured values depending upon and weighted with, the respective variable of its coherence.

This further filter is intended, in particular, to exclude short-term disturbances or noise not correlated with the excitation signal, in the amplitude range of the excitation signal from the resulting measurement. It is often advantageous in practice to provide for the upstream inclusion of the above-described "excursion filter" since for very large signal amplitudes the actual measured value H(fj) dominates the coherence and can thus heavily falsify the entire measurement.

In FIG. 2 to 7 schematic drawings are shown of arrangements for determining an averaged frequency-dependent transfer function for a linear time-invariant system in conjunction with various examples of application. In FIG. 2 this is illustrated for an acoustic real time measurement. FIG. 3 refers to an electric test measurement. FIGS. 4 and 5 relate to an oceanographic measurement as well as an acoustic tomography. Finally FIGS. 6 and 7 relate to a geological as well as a climatological measurement.

Identical features in FIG. 2 to 7 are marked with the same reference symbols as in FIG. 1.

Initially an application is explained for a measuring process, where physical measured values are derived from physical input variables. In particular a linear time-invariant system (LTI system) is assumed the response function of which can be determined from the physical output variables of an excitation with known physical input variables. In practice such measurements are always accompanied by disturbance: background noise, short, high-amplitude disturbances and uncorrelated disturbance signals incoherent with the excitation. When determining the transfer function these effects overlaying the measured time series of the variables under consideration are removed by arranging filters upstream of the actual evaluation by deconvolution, provided that the disturbances are not dependent upon the excitation signal and change much more quickly than the linear time-invariant system itself.

Determination of the averaged transfer function may be performed in real time. The inputs of the evaluation device are evaluated while further data are received at the input in parallel.

An application during subsequent processing may also be provided. Inputs are present as stored data in analogous or digital form and are fed into the measuring system. Filtering may be arranged at any time after the reception of raw data. Measured raw data are typically initially converted into an electric signal, digitised and recorded. Evaluation as such then takes place by means of feeding the data or playing them back into an evaluation device. The asynchronisity of this operation has some advantages in practice. Thus, for example, evaluation parameters can be better optimised since the available time in situ is limited as a rule at the time of measuring. In particular, the evaluation operation may be repeated in such a way that the data are input again but with different evaluation parameters, whereas individual events in the raw data can, by nature, not be reproduced in situ at the time of data acquisition. And frequently direct evaluation in situ it is not possible due to local conditions (measurements at the South Pole or similar) or due to time scales (years in oceanography).

The process for determining the averaged transfer function in one of the above-described arrangements may, for example, be used in conjunction with acoustic real time measurement in a full stadium (see FIG. 2).

The output signal is an arbitrary audio signal having a sufficiently wide bandwidth for the transfer function to be determined. It is output in the stadium from the mixer via amplifiers and via loudspeakers. The reference signal is electrically received from the mixer and played onto the computer via A/D converters. The measuring signal is received electrically from the microphone in the stadium which picks up the acoustic signal at the reception point. The measuring chain is thus comprised of loudspeaker, transmission path in the stadium and microphone. The input signals are all electric (U in V), but may also be understood acoustically (p in Pa) either individually or as a whole, when the microphone or the loudspeakers are calibrated (Pa/V or V/Pa).

Related embodiments comprise measuring a loudspeaker in a laboratory for the purpose of loudspeaker design, room-acoustic measurements, for example in theatres, churches, railway stations or automated test measurements of voice evacuation systems.

Initial signal recording and subsequent separate evaluation may also be provided.

The process for determining the averaged transfer function in one of the above-described arrangements may further be utilised (see FIG. 3) in conjunction with an electric test measurement, for example for line monitoring of electro-acoustic and electric installations.

The output signal is an arbitrary play-back signal having a sufficiently wide bandwidth for the transfer function to be determined. It is output in the stadium from the CPU via amplifiers and via loudspeakers. The reference signal is received electrically from the mixer and played onto the computer via A/D converters. The measuring signal for the linear time-invariant system is received electrically from the output of the electric reproduction chain and is typically drawn off behind the amplifier and ahead of the loudspeaker. The measuring chain thus includes the complete electric transmission path on the output side. The measured variables of the inputs are all electric (U in V).

Related embodiments comprise the test measurement or tuning of a DSP controller or the impedance measurement of the electric reproduction chain.

Initial signal recording and subsequent separate evaluation may also be provided.

The process for determining the averaged transfer function in one of the above-described arrangements may further be utilised (see FIG. 43) in conjunction with oceanography, for example when determining spatial and temporal response functions such as water level in the Baltic Sea as a response function of wind direction and wind force, which will now be explained.

The reference signal are the measured wind force components North and East in the area of the Danish straits (Sund and Belts), for example Cap Arkona, the meteorological station of the German weather service. The measuring signal is the water level from the SMHI in Landsort, Sweden. The signals are converted from mechanical signals into electric signals and recorded hourly and processed later. The result obtained represents the dependence of the level at Landsort as the response function of the Baltic Sea in response to the North and East component of the wind vector in the Danish straits. The typical length of the response function is 10 days.

Practically relevant are, for example, the estimates of the effects of building projects such as the Fehmarn Belt bridge.

The measuring chain, on the reference side, includes the mechanical signal recorder for wind direction and wind speed, which are converted into an electric signal, digitised and stored. Water level measuring is carried out and recorded in a similar manner.

Related embodiments comprise the measurement of other oceanographic variables or dependencies such as pressure, temperature, salinity, flow velocity.

The process for determining the averaged transfer function in one of the above-described arrangements may also be utilised in conjunction with acoustic tomography. (see FIG. 5), i.e. the measurement of temperature distribution in oceans by means of low-frequency acoustic signals.

The reference signal, in one arrangement, is an excitation signal introduced via an underwater loudspeaker. The measuring signal is the response to the excitation of the ocean recorded by an underwater microphone. If the bathymetry, i.e. the reflexion paths are known, conclusions may be drawn from the run-time of individual reflexions as to the spatial temperature distribution, since the speed of sound depends essentially upon the temperature along the propagation path. The input signals are all electric (U in V), but may also be understood acoustically (p in Pa) either individually or as a whole, when the microphone or the loudspeakers are calibrated (Pa/V or V/Pa). Evaluation may be performed in real time or separately thereafter.

The process for determining the averaged transfer function in one of the above-described arrangements may further be utilised in conjunction with geology (see FIG. 6), i.e. when determining location, thickness, structure and dimensions of shells/layers inside the earth.

The reference signal is an acoustic, locally recorded excitation signal, frequently triggered, for example, by blasting, subterranean atomic explosions or earth quakes. The measuring signal is an acoustically recorded signal at very remote receiving locations. The response functions of different measuring locations result in a three-dimensional response function to selected excitation. From this conclusions can be drawn as to the structure of the earth interior. The input signals are all electric (U in V), but may also be understood acoustically (p in Pa) or mechanically (F in N) either individually or as a whole, depending on the calibration of the signal recorders.

A further embodiment relates to climatology, such as when measuring the effect of changes in radiation intensity of the sun upon climatological variables such as precipitation (see FIG. 7).

The reference signal here is a measured modulation of the radiation intensity of the sun, preferably by a satellite. This is typically considerably impacted by the sun spot cycle. The measuring signal used is the precipitation series for St. Helena in the South Atlantic, recorded in mm for the monthly average. The result is the dependency of precipitations as the response function to the variation in solar radiation or the significance of sun spots. The inputs, after conversion of the intensity or precipitation quantity, are electrically available (U in V) and are digitally recorded. Evaluation is typically carried out thereafter separately from the measurement as such.

Related embodiments comprise the measurement of the CO2 content of the atmosphere in Hawaii and the air temperature at various locations for determining correlations or response functions as well as the measurement of water temperatures off Peru and air temperatures in Cape Town, South Africa, for characterising the atmospheric teleconnection as the response function to the El Nino phenomenon.

The features of the invention, disclosed in the above description, the claims and the drawing can be of importance, both individually and in any given combination, to the realisation of the invention in its various embodiments.

The invention claimed is:

1. A method for determining an averaged frequency-dependent transfer function for a linear time-invariant system by an evaluation device, wherein the method comprises:

providing frequency-dependent reference signals at an input channel of the evaluation device, wherein the frequency-dependent reference signals are derived from excitation signals applied to a linear time-invariant system, providing frequency-dependent measuring signals at the input channel of the evaluation device, wherein the frequency-dependent measuring signals are determined for the linear time-invariant system in response to an excitation of the linear time-invariant system with the excitation signals, and wherein the frequency-dependent measuring signals are associated with the frequency-dependent reference signals, and determining, by the evaluation device, an averaged frequency-dependent transfer function for the linear time-invariant system, in that using signal deconvolution of associated measuring signals and reference signals selected from the frequency-dependent measuring signals and the frequency-dependent reference signals, frequency-dependent transfer functions are determined block-by-block such that for each block of associated measuring signals and reference signals a transfer function is determined and the frequency-dependent transfer functions are averaged, wherein when determining the averaged transfer function at least a part of the determined frequency-dependent transfer functions is included in the averaging corresponding to a respectively associated frequency-dependent weighting.

2. The method according to claim 1, wherein when determining the averaged frequency-dependent transfer function an existing averaged frequency-dependent transfer function is averaged with a currently determined frequency-dependent transfer function, wherein the currently determined frequency-dependent transfer function is included in the averaging corresponding to the associated frequency-dependent weighting.

3. The method according to claim 1 wherein the at least one part of the determined frequency-dependent transfer functions is weighted, respectively, corresponding to a frequency-dependent threshold value function.

4. The method according to claim 2 wherein the at least one part of the determined frequency-dependent transfer functions is weighted, corresponding to a respective frequency-dependent distance function, wherein the metric distance function indicates the frequency-dependent weighting in dependence of a metric distance between the existing averaged frequency-dependent transfer function and the currently determined frequency-dependent transfer function.

5. The method according to claim 1, wherein the at least one part of the determined frequency-dependent transfer functions is weighted corresponding to a respective frequency-dependent correlation function, wherein the correlation function indicates the frequency-dependent weighting for a frequency-dependent transfer function in dependence of a correlation between the frequency-dependent reference signal and the associated frequency-dependent measuring signal, from which the frequency-dependent transfer function is determined.

6. The method according to claim 1, wherein the averaged frequency-dependent transfer function is determined in terms of a real-time measurement for the linear time-invariant system.

7. An evaluation device for determining an averaged frequency-dependent transfer function for a perturbed linear time-invariant system, comprising:

a plurality of input channels configured to receive frequency-dependent reference signals derived from excitation signals acting upon a linear time-invariant system and frequency-dependent measuring signals, wherein the frequency-dependent measuring signals are determined for the linear time-invariant system in response to an excitation of the linear time-invariant system with the excitation signals, and wherein the frequency-dependent measuring signals, and wherein the frequency-dependent measuring signals are associated with the frequency-dependent reference signals, and an evaluation unit coupled to the several input channels and configured to determine an averaged frequency-dependent transfer function for the linear time-invariant system, in that using signal deconvolution of mutually associated measuring signals and reference signals selected from the measuring signals and the reference signals, frequency-dependent transfer functions are determined block-by-block such that for each block of associated measuring signals and reference signals a transfer function is determined and the frequency-dependent transfer functions are averaged, wherein when the averaged frequency-dependent transfer function is determined at least a part of the determined frequency-dependent transfer functions is included in the averaging corresponding to a respectively associated frequency-dependent weighting.

8. A computer program product with program code stored on a non-transitory tangible computer-readable storage medium and for causing a computing device to perform a process according to claim 1.

* * * * *